US006758681B2

(12) United States Patent
Johnson, Jr.

(10) Patent No.: US 6,758,681 B2
(45) Date of Patent: Jul. 6, 2004

(54) ELECTRICAL CABLE INTERCONNECTIONS FOR REDUCED IMPEDANCE MISMATCHES

(76) Inventor: Morgan T. Johnson, Jr., 2370 SW. Cedar, Portland, OR (US) 97205

( * ) Notice: Subject to any disclaimer, the term of this patent is extended or adjusted under 35 U.S.C. 154(b) by 0 days.

(21) Appl. No.: 10/187,717

(22) Filed: Jul. 1, 2002

(65) Prior Publication Data

US 2004/0002232 A1 Jan. 1, 2004

(51) Int. Cl.[7] ..... H01R 12/00
(52) U.S. Cl. ..... 439/66
(58) Field of Search ..... 439/63, 66

(56) References Cited

U.S. PATENT DOCUMENTS 3,757,272 A * 9/1973 Laramee et al. ..... 439/63
4,534,602 A * 8/1985 Bley ..... 439/63
4,603,926 A * 8/1986 Nesbit et al. ..... 439/63
5,007,843 A * 4/1991 Smolley ..... 439/66
5,788,516 A * 8/1998 Uggmark ..... 439/86
5,795,162 A * 8/1998 Lambert ..... 439/63
5,886,590 A * 3/1999 Quan et al. ..... 333/33

* cited by examiner

*Primary Examiner*—Tulsidas C. Patel
(74) *Attorney, Agent, or Firm*—Raymond J. Werner

(57) ABSTRACT

Reduced impedance mismatches are obtained when coupling electrical signalling media by replacing conventional connector architectures, which disrupt transmission line characteristics, with an electrical coupling means that permits the electrical signalling media to present a planar interface for interconnection. A connector suitable for electrically coupling a first pair of coaxially arranged conductors to a second pair of conductors disposed on a substrate includes a housing adapted to receive at least one coaxial cable having a planar interface, wherein the planar interface comprises a first conductor surface, a first dielectric surface, and a second conductor surface, the three surfaces being substantially coplanar with each other, and a connector bottom mechanically coupled to the housing and coupled to the planar coax cable interface, wherein the connector bottom comprises an electrically insulative portion, the electrically insulative portion having at least two major surfaces; and at least two electrically conductive portions.

11 Claims, 18 Drawing Sheets

System only includes ~24" of medium performance flex coax cables

System flex coax plus 12" of 0.085" diameter Micro-Coax semi-rigid with SMAs

Thomas & Betts MPI inserted in the middle of the Reference cable

Cinch Fuzz Buttons Inserted in the middle of Reference cable

ELECTRICAL CABLE INTERCONNECTIONS FOR REDUCED IMPEDANCE MISMATCHES

BACKGROUND OF THE INVENTION

1. Field of the Invention

The present invention relates generally to the field of electrical cables and connectors, and more particularly relates to impedance matching for transmission line connections.

2. Background Information

Advances in semiconductor manufacturing processes have resulted in the production of integrated circuits having many millions of transistors as well as other active and passive components. The same advances that have provided the reduction in physical dimensions necessary to integrate millions of electrical elements on a single chip, also provide dramatic increases in operating frequency for these integrated circuits. Integrated circuits implementing logic functions now commonly operate at several GHz, and an order of magnitude increase in operating frequency is expected within a few years.

As is well known, integrated circuits are commonly given a protective package, and then mounted on, or otherwise coupled to, a substrate such as a printed circuit board. In the past, when operating frequencies, sometimes referred to as operating speeds, were much lower, the primary limitation on system performance was the ability of the integrated circuits to operate at higher speeds, rather than the intra-board, or inter-board interconnection schemes. However, at very high speeds it became common to require that special attention be given to the design and implementation of those intra-board and inter-board interconnections so that the performance of electronic systems incorporating integrated circuits that operate at very high speeds would not be unduly limited by those interconnections.

When providing for the signal pathways between components which generate very high frequency signals as outputs, it is sometimes necessary to provide interconnections such as differential pairs, wave guides, or transmission lines. Transmission line characteristics may be achieved by a form of interconnection known as coaxial cables, which are more simply known as coax cables, or coax.

Coax cables typically have a center conductor surrounded by a dielectric material, an electrically conductive shield surrounding the dielectric material, and an insulator that covers the outer surface of the shield. In order to couple a coax cable to a board, a chassis, another coax cable, or any other point of electrical connection, a connector is fitted to an end of the coax cable, such that it may physically connect to, or mate with, a corresponding connector on the board, chassis, or other point. Fitting the connector to the coax cable typically involves cutting back one or more of the insulator that covers the outer surface of the shield, the electrically conductive shield, and the dielectric material, such that the center conductor extends outwardly from the end of the cable and thereby facilitates fitting of the connector to the cable. Once the two aforementioned connectors are joined, an electrical connection is formed between the coax cable and whatever other conductive media it has been joined to by the connector.

It has been observed that discontinuities in electrical characteristics, where two conductors are joined, may result in degradation in electrical performance which limits the frequency of signals that may be successfully communicated through such joined conductors. These limiting discontinuities include impedance mismatches.

What is needed are methods and apparatus for providing connectors and connection schemes suitable for reducing the impedance mismatches that limit performance in very high speed electrical systems.

SUMMARY OF THE INVENTION

Briefly, methods and apparatus are provided in accordance with the present invention in which an electrical connection between at least two conductors is obtained with very low, or zero, impedance mismatch.

In one exemplary embodiment of the present invention, reduced impedance mismatches are obtained when coupling electrical signalling media by replacing conventional connector architectures, which disrupt transmission line characteristics, with an electrical coupling means that permits the electrical signalling media to present a planar interface for interconnection. Such electrical coupling means include, but are not limited to, pressure connections which may be implemented by anisotropic conductors, C-shaped spring connectors, or any other suitable means of making an electrical connection between two substantially planar conductor surfaces.

BRIEF DESCRIPTION OF THE DRAWINGS

The present invention is described herein by way of exemplary embodiments, but not limitations, illustrated in the accompanying drawings in which like references denote similar elements.

FIG. 4 is a high-level representation of a network analyzer test set-up.

FIG. 5 is a high-level representation of a time domain reflectometry test set-up.

FIG. 6 is a high-level representation of a time domain transmission test set-up.

FIG. 7 is a diagram showing signal attenuation over a frequency range of 0 to 6 GHz for both an uncut semi-rigid section of coaxial cable used as a reference, and a cut version of the same with a first type of electrical conductor disposed between the two portions of the cut semi-rigid cable.

FIG. 8 is a diagram showing signal attenuation over a frequency range of 0 to 6 GHz for both an uncut semi-rigid section of coaxial cable used as a reference, and a cut version of the same with a second type of electrical conductor disposed between the two portions of the cut semi-rigid cable.

FIG. 9 is a diagram showing signal attenuation over a frequency range of 0 to 6 GHz for about 24 inches of medium performance flex coax cable, used to characterize the test equipment.

FIG. 10 is a diagram showing signal attenuation over a frequency range of 0 to 6 GHz for the reference cable which consists of the system flex coax cable as described in conjunction with FIG. 9, when that system flex coax cable also has about 12 inches of 0.085 inch diameter Micro-Coax semi-rigid cable with Sub Miniature Type A (SMA) connectors coupled thereto.

FIG. 11 is a diagram showing signal attenuation over a frequency range of 0 to 6 GHz for the reference cable set-up with a first conductive material inserted therebetween.

FIG. 12 is a diagram showing signal attenuation over a frequency range of 0 to 6 GHz for the reference cable set-up with a second conductive material inserted therein.

FIG. 13 is a time domain reflectometry picture of test set-up with flex cables coupled to semi-rigid cables and the semi-rigid cables having a low impedance coupling.

FIG. 14 is a time domain transmission picture of the reference set-up versus the reference set-up with a first conductive material inserted therein.

FIG. 15 is a time domain transmission picture of the reference set-up versus the reference set-up with a second conductive material inserted therein.

DETAILED DESCRIPTION

In the following description, various aspects of the present invention will be described. However, it will be apparent to those skilled in the art that the present invention may be practiced with only some or all aspects of the present invention. For purposes of explanation, specific numbers, materials and configurations are set forth in order to provide a thorough understanding of the present invention. However, it will also be apparent to one skilled in the art that the present invention may be practiced without the specific details. In other instances, well-known features are omitted or simplified in order not to obscure the present invention.

Reference herein to "one embodiment", "an embodiment", or similar formulations, means that a particular feature, structure, or characteristic described in connection with the embodiment, is included in at least one embodiment of the present invention. Thus, the appearances of such phrases or formulations herein are not necessarily all referring to the same embodiment. Furthermore, various particular features, structures, or characteristics may be combined in any suitable manner in one or more embodiments.

As noted above, coax cables typically have a center conductor surrounded by a dielectric material, an electrically conductive shield surrounding the dielectric material, and an insulator that covers the outer surface of the shield. In conventional connection schemes for coaxial cables, a connector is fitted to an end of a coaxial cable in such a way that portions of one or more of the insulator, the electrically conductive shield, and the dielectric material, such that an electrical connection is made between the connector and both the shield and the center conductor. More particularly, fitting the connector to the coax cable typically involves cutting back one or more of the insulator, the shield, and the dielectric material, such that the center conductor extends outwardly from the end of the cable and thereby facilitates fitting of the connector to the cable. Unfortunately, the impedance seen by an electrical signal traversing that portion of the center conductor that, due to the cutting back needed for attaching the connector to the cable, no longer has a coextensive relationship with the dielectric, shield, and/or insulator, is different than that seen in the rest of the coaxial cable. Such impedance changes may limit the electrical performance of a system employing conventional connectors. It is noted that, in addition to coaxial cables, other signalling media, such as, for example, twisted pairs, may also experience impedance changes resulting from attachment of connectors thereto.

Figure 1:
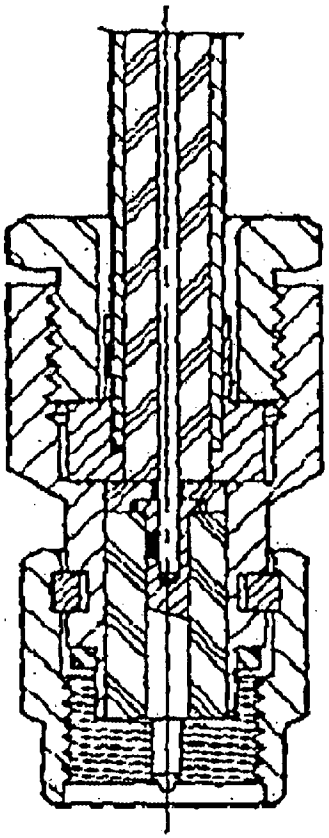
FIG. 1 is a cross-sectional view of a conventional connector for electrically coupling a coaxial cable to conductors outside of the coaxial cable.

Referring to FIG. 1, a cross-sectional view of a conventional connector for electrically coupling a coaxial cable to conductors outside of the coaxial cable is shown. More particularly, Reduced impedance mismatches can be obtained, in accordance with the present invention, when coupling electrical signalling media by replacing conventional connector architectures, which disrupt transmission line characteristics, with an electrical coupling means that permits the electrical signalling media to present a planar interface for interconnection. Such electrical coupling means include, but are not limited to, pressure connections which may be implemented by anisotropic conductors, C-shaped spring connectors, or any other suitable means of making an electrical connection between two substantially planar conductor surfaces. Generally, such suitable means of making an electrical connection between two substantially planar conductor surfaces in accordance with the present invention, are configured such that as short a signal path as possible or practical is presented between those two substantially planar conductor surfaces.

Anisotropic conductors provide electrical communication in one direction such that a single piece of anisotropic conductive material may be contacted on one of its major surfaces by two or more electrical conductors, and electrical connection may be had with each of the two or more electrical conductors at an opposite major surface thereof without the two or more electrical conductors being shorted together. Anisotropic conductors typically comprise a compressible or elastomeric material with electrically conductive materials embedded therein. Rubber is an example of an elastomeric material used to produce sheets of anisotropic conductive material. Various non-conductive foams, may also be used as a matrix within which electrically conductive material is disposed in a manner such that electrical conduction takes place in substantially one axis, but not others.

Examples of anisotropic conductors that may be used in conjunction with implementations of the present invention include, but are not limited to, Thomas & Betts (Tyco), of Memphis, Tenn., metallized particle interconnect bumps; Tecknit, of Fuzz Buttons, InterCon cLGA™ land grid arrays from InterCon Systems; Shin Etsu, of Tokyo, Japan, MAF anisotropic sheets; Shin Etsu's GBM anisotropic sheets; Paricon, of Fall River, Mass., Fused Particle Sheets; Fujipoly, of Cateret, N.J. ordered wire cluster sheet; and Fujipoly's extruded "zebra" type connectors. The metallized particle interconnect bumps by Thomas & Betts (Tyco) Corp. of Memphis, Tenn., are molded though a polyimide sheet that includes denting and piercing metal particles (about one micron in size), and gold-plated in an elastomeric matrix. Tecknit, of Cranford, N.J., Fuzz Buttons are land grid array connectors including gold-plated molybdenum wires of sizes such as 1 mil or 2 mil diameter, forming a compressible connector held in a plastic hole grid. InterCon cLGA™ land grid arrays from InterCon Systems of Harrisburg, Pa., include an array of C-shaped stampings, gold-plated, and held captive in an injection molded plastic matrix. The C-shaped stamping is capable of flexing. Shin Etsu's MAF anisotropic sheet is a Silastic sheet with tightly packed but randomly spaced, gold-plated wires (typically 2 mils in diameter) that are essentially vertical in their orientation with respect to sheet (i.e., essentially perpendicular to the plane of the major surface of the sheet. Shin Etsu's GBM anisotropic sheet is a Silastic sheet with evenly spaced wires (typically 2 mil diameter wires placed on 4 mil centers) that are inclined from the vertical to accommodate compression. Paricon's Fused Particle Sheet includes small silver-plated or gold-plated nickel particles embedded in a rubber sheet. During the manufacturing of such sheets, when the rubber is still liquid, particles are chained in a substantially vertical position. Fujipoly's ordered wire cluster sheet includes clusters of slightly bowed wires held in a rubber sheet so that the ends of the wires dig into pads on either side of the sheet upon being subjected to compression. Fujipoly's extruded "zebra" type connectors include particles in an open foam matrix, where the foam acts as the dielectric. These sheets are available in stripes, or as custom-extruded concentric circles (i.e., disks).

A useful property of anisotropic conductors is their ability to accommodate non-planarities between two surfaces. These non-planarities, or other obstacles to making an electrical connection may include, but are not limited to, roughness, smoothness, warpage, tilting, recesses, surface oxidation, contamination, dielectric particles, and misalignments.

In an illustrative embodiment of the present invention, a coaxial cable having a planar interface is coupled to a substrate such that the dielectric which surrounds the center conductor, the shield which surrounds the dielectric, and the outer insulator which surrounds the shield, are coextensive with the center conductor. In a further aspect of the present invention as found in this illustrative embodiment, an anisotropic conductor provides electrical connection the between the center and shield conductors of a coaxial cable having a planar interface, and corresponding signal paths outside of the coaxial cable.

In another aspect of the present invention, an electrically insulative housing adapted to receive at least a portion of a coaxial cable, provides mechanical alignment and support for the coaxial cable having a planar interface.

In an alternative illustrative embodiment of the present invention, a twisted pair of insulated conductors, each of the pair having a conductor surrounded by an insulative layer, electrically couples with a corresponding pair of electrical terminals by way of a planar interface. In this way, impedance mismatches typically introduced by conventional connectors are substantially reduced or eliminated.

In one embodiment of the present invention, a connector suitable for electrically coupling a first pair of coaxially arranged conductors to a second pair of conductors disposed on a substrate, with excellent impedance matching characteristics includes a housing adapted to receive at least one coaxial cable having a planar coax cable interface, wherein the planar coax cable interface comprises a first conductor surface, a first dielectric surface, and a second conductor surface, the three surfaces being substantially coplanar with each other, and a connector bottom mechanically coupled to the housing and coupled to the planar coax cable interface, wherein the connector bottom comprises an electrically insulative portion, the electrically insulative portion having at least two major surfaces; and at least two electrically conductive portions. The housing is adapted to mechanically couple at least the connector bottom to the substrate, thereby providing electrical connection between the planar coax cable interface and conductors of the substrate.

In various illustrative embodiments of the present invention presented herein, methods of assembling and connecting connectors for coupling electrical signalling media are also disclosed.

Figure 2:
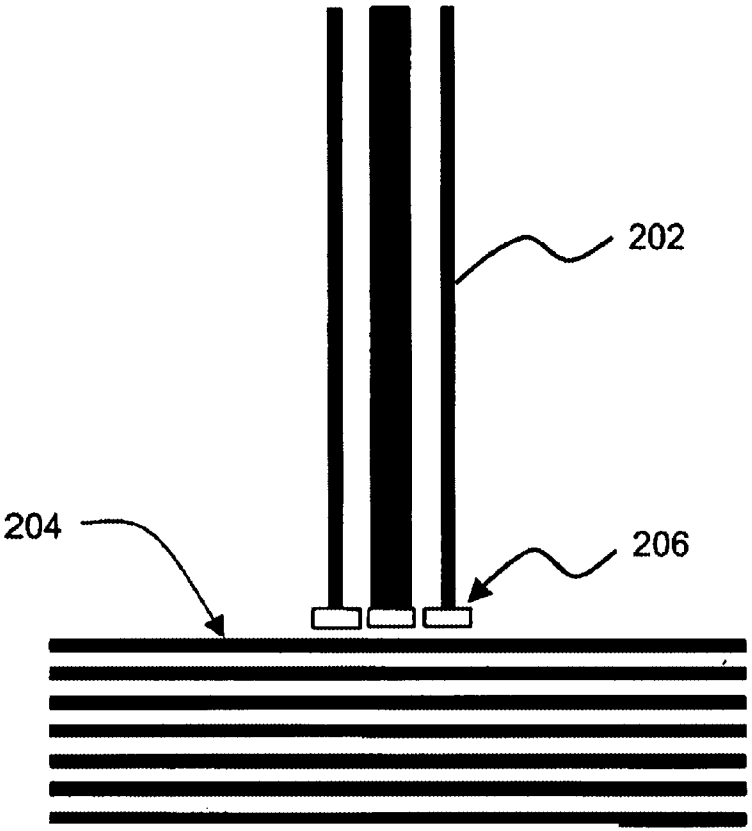
FIG. 2 is a cross-sectional view of a connection between a coaxial cable, having a planar interface, and a substrate, in accordance with the present invention.

FIG. 2 is a cross-sectional view of a connection between a coaxial cable, having a planar interface, and a substrate, in accordance with the present invention. It can be seen that coax cable 202 has a center conductor and an outer shield conductor. In accordance with the present invention, coax cable 202 has a planar coax interface 206 that is coupled to a substrate 204 so as to keep the signal within the coax cable for a greater length than is achievable with conventional connector assemblies. Substrate 204 may be a printed circuit board or another connector. The planar coax interface of the present invention provides for reduced impedance mismatches by maintaining the distance of the interface disruption (such as those caused by conventional connector assemblies) to dimensions as small as permitted. Such distances may be effectively zero where the planar coax interface is mated directly to another set of conductors, or some small distance such as the thickness of an anisotropic conductive sheet.

Figure 3:
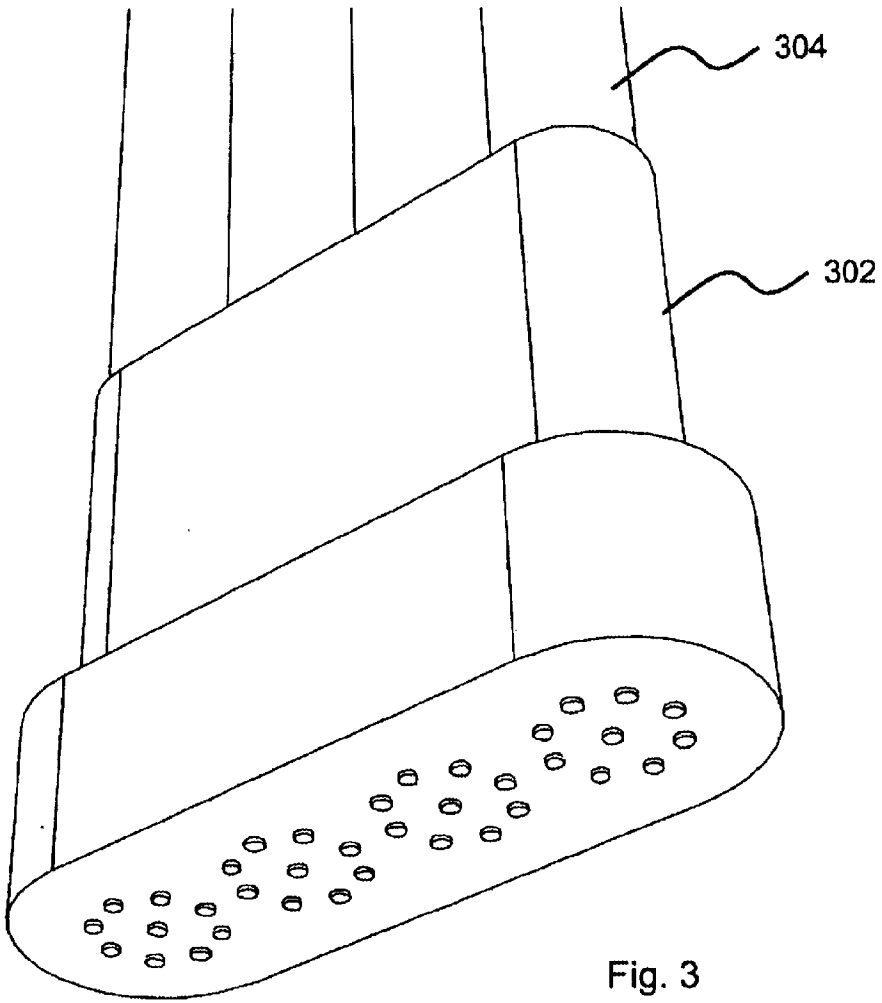
FIG. 3 is a cross-sectional view of an electrically insulative housing that is adapted to receive at least a portion of a coaxial cable, provide mechanical alignment and support for the coaxial cable having a planar interface.

FIG. 3 is a cross-sectional view of an electrically insulative housing that is adapted to receive at least a portion of a coaxial cable, and to provide mechanical alignment and support for the coaxial cable having a planar interface in accordance with the present invention. As can be seen in the figure, coax cables 304 fit into housing 302. Housing 302 may be formed of any suitable material, and is typically formed from an electrically insulating material such as plastic which has adequate stiffness to provide the mechanical support required for a particular configuration. The selection of materials for such a housing is well known in this field.

Figure 4:
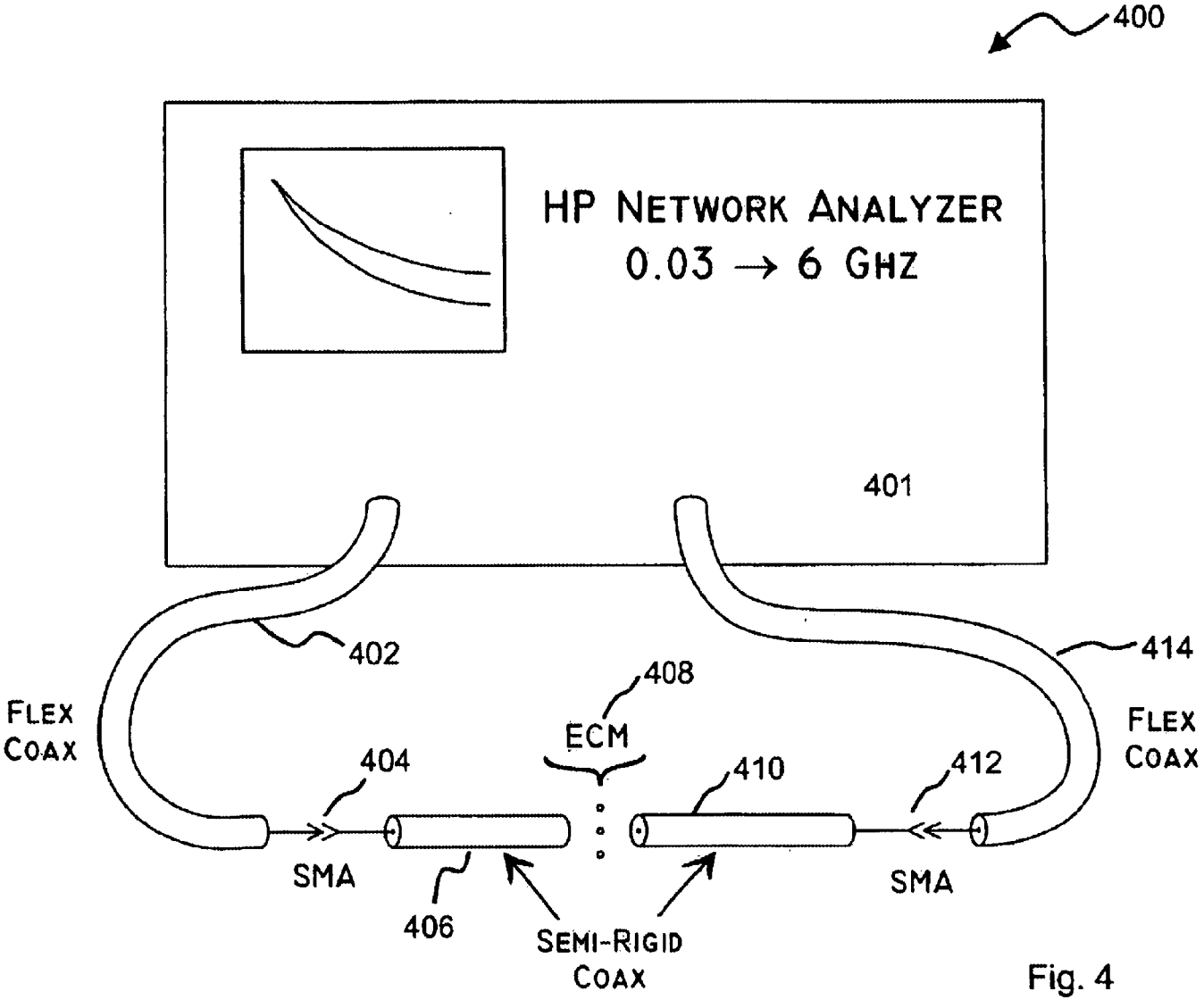
FIGS. 4–6 are schematic representations of various calibration and test set-ups used for comparing the electrical performance of conventional cables and connectors to the cables and connectors of the present invention.
Figure 5:
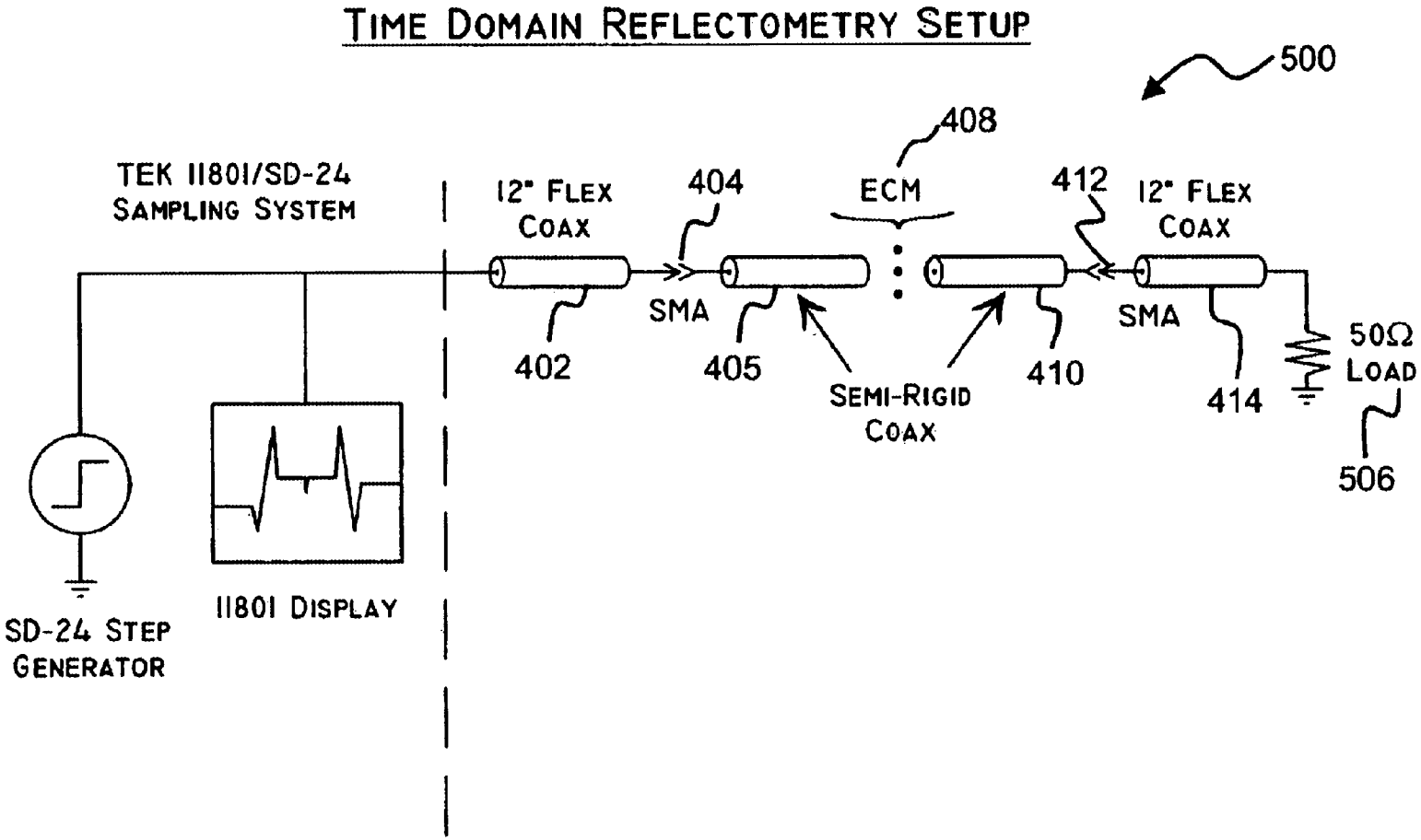
Figure 6:
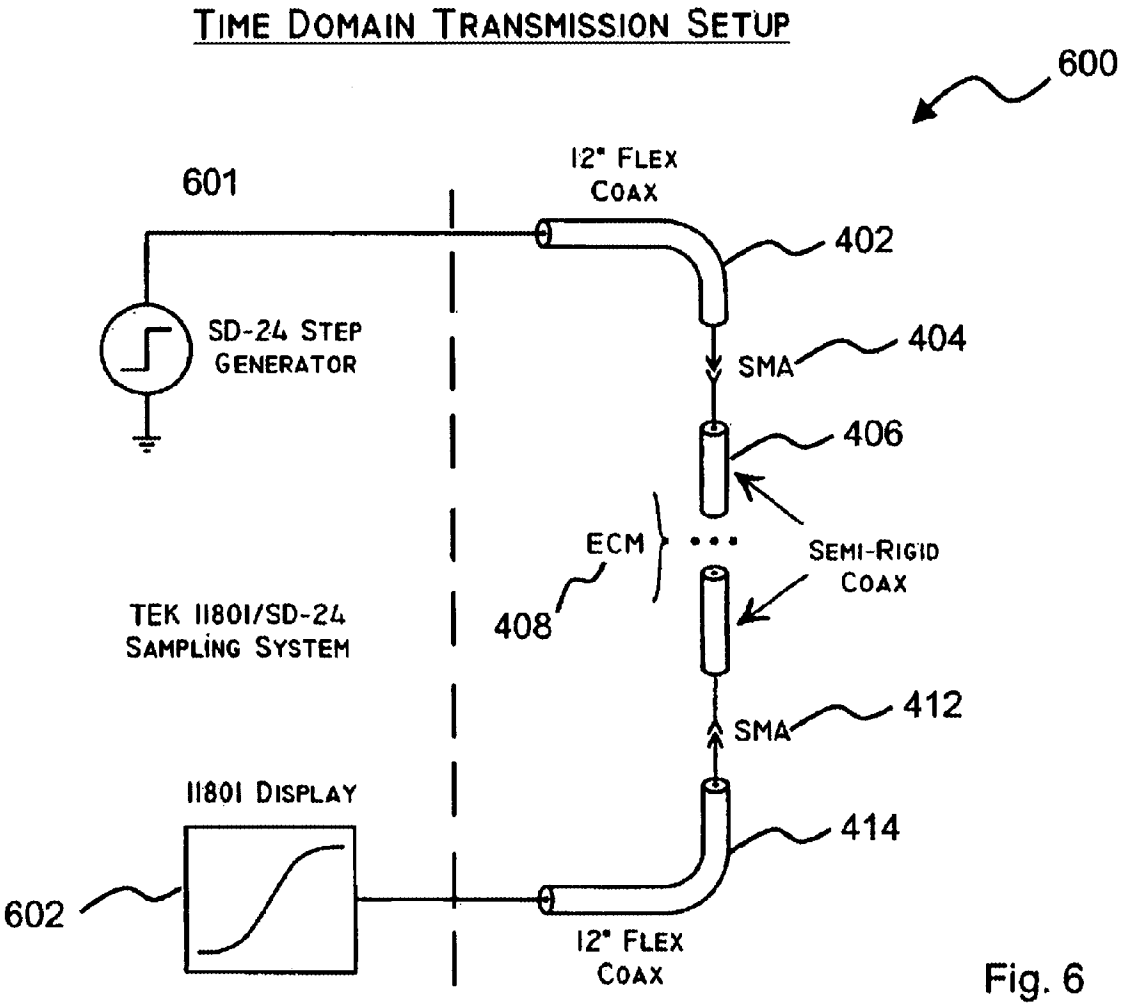

FIGS. 4–6 are schematic representations of various calibration and test set-ups used for comparing the electrical performance of conventional cables and connectors to the cables and connectors of the present invention.

FIG. 4 is a high-level representation of a network analyzer test set-up 400. A network analyzer 401 is used to characterize the performance various cable components so that electrical performance changes, if any, introduced by embodiments of the present invention can be quantified. In test set-up 400, network analyzer 402 is coupled to a first end of a flex coax segment 402 which has a second end coupled to SMA connector 404. A first semi-rigid coax cable segment 406 is coupled at one of its ends to SMA connector 404 and at its other to ECM (i.e., a low impedance electrical connection mechanism) connector 408. A second semi-rigid coax cable segment 410 is coupled at one of its ends to ECM connector 408 and at its other end to SMA connector 412. Finally, a second flex coax segment 414 is coupled at one of its ends to SMA connector 412 and its other end to network analyzer 401. For system calibration, flex coax segments 402 and 414 are connected directly together. For calibration purposes with respect to the semi-rigid segments 406 and 410, an uncut semi-rigid cable is inserted in their place.

FIG. 5 is a high-level representation of a time domain reflectometry test set-up 500. Set-up 500 includes a step generator 502, a sampling system 504 coupled to step generator 502 at a node 505. Set-up 500 has a signal pathway coupled to node 505 that includes a flex coax segment 402 coupled to SMA connector 404; a first semi-rigid coax cable segment 406 coupled to SMA connector 404 and to ECM connector 408; a second semi-rigid coax cable segment 410 coupled to ECM connector 408 and to SMA connector 412; and a second flex coax segment 414 coupled to SMA connector 412 and to load resistor 506 the other end of which is coupled to ground. As with the test set-up of FIG. 4, for system calibration, flex coax segments 402 and 414 are connected directly together; and for calibration purposes with respect to semi-rigid segments 406 and 410, an uncut semi-rigid cable is inserted in their place.

FIG. 6 is a high-level representation of a time domain transmission test set-up 600. Set-up 600 includes a step generator 502 coupled to a node 601, a signal pathway coupled to node 601 that includes a flex coax segment 402 coupled to SMA connector 404; a first semi-rigid coax cable segment 406 coupled to SMA connector 404 and to ECM connector 408; a second semi-rigid coax cable segment 410 coupled to ECM connector 408 and to SMA connector 412; and a second flex coax segment 414 coupled to SMA connector 412 and to a display device 602. As with the test set-ups of FIGS. 4 and 5, for system calibration, flex coax segments 402 and 414 are connected directly together; and for calibration purposes with respect to semi-rigid segments 406 and 410, an uncut semi-rigid cable is inserted in their place.

FIGS. 7–15 are electrical characterization diagrams developed in the course of characterizing references, as well as the performance of various embodiments of the present invention.

Figure 7:
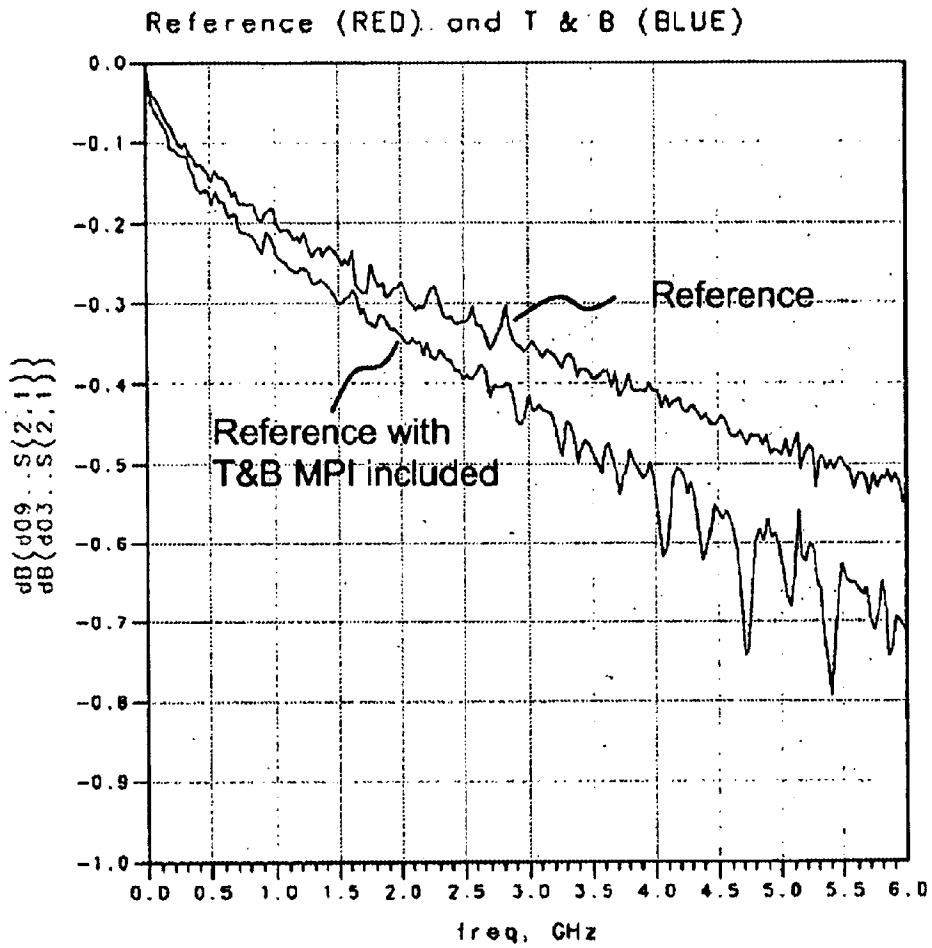
FIGS. 7–15 are electrical characterization diagrams developed in the course of characterizing references, as well as the performance of various embodiments of the present invention.

FIG. 7 is a diagram showing signal attenuation over a frequency range of 0 to 6 GHz for both an uncut semi-rigid section of coaxial cable used as a reference, and a cut version of the same with a first type of electrical conductor disposed between the two portions of the cut semi-rigid cable. As can be seen in the figure, from 0 up to approximately 4 GHz, there is less than 0.1 dB difference between the reference setup and the cable with the connection scheme of the present invention. Between 4 GHz and 6 GHz the difference, with the exception of a few spikes is in the tends to be in the range of 0.1 to 0.2 dB, and with measured spike in this specific example at approximately 4.1 GHz, 4.3 GHz, 4.7 GHz, and 5.4 GHz, where the difference between the reference and the spikes is in the range of 0.2 to 0.3 dB. In the example of FIG. 7, the connection between the cut portions of the cable is made with anisotropic conductors, and specifically with metal particle interconnect product from Thomas & Betts (Tyco). More particularly, these metal particle interconnect products are in the form of bumps molded through a polyimide sheet consisting of denting and piercing metal particles (approximately 1 micron in size), gold plated in an elastomeric matrix.

Figure 8:
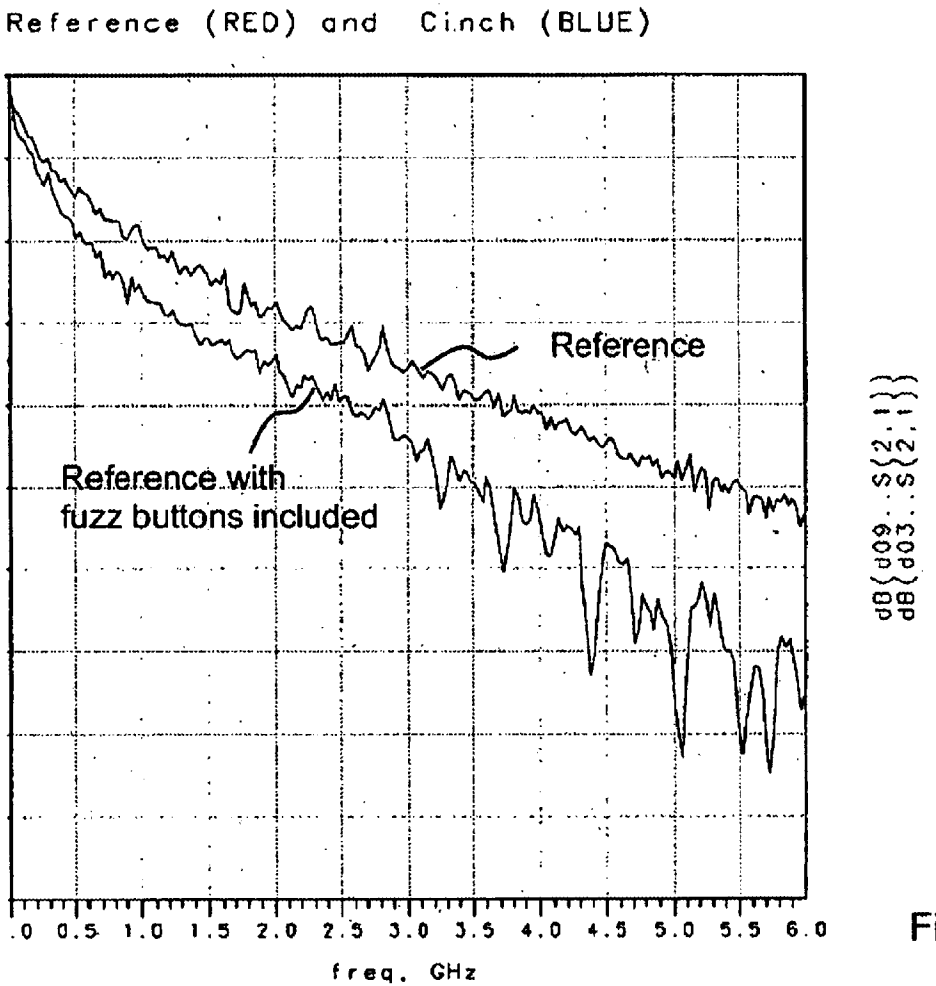

FIG. 8 is a diagram showing signal attenuation over a frequency range of 0 to 6 GHz for both an uncut semi-rigid section of coaxial cable used as a reference, and a cut version of the same with a second type of electrical conductor disposed between the two portions of the cut semi-rigid cable. As can be seen in the figure, from 0 up to approximately 3 GHz, there is less than 0.1 dB difference between the reference setup and the cable with the connection scheme of the present invention using the second type of electrical conductor. Between 3 GHz and 6 GHz the difference, with the exception of a few spikes tends to be in the range of 0.1 to 0.2 dB, and with measured spikes in this specific example at approximately 3.3 GHz, 3.7 GHz, 4.4 GHz, 5.1 GHz, 5.5 GHz, and 5.7 GHz, where the difference between the reference and the spikes is in the range of approximately 0.15 to 0.3 dB. In the example of FIG. 8, the connection between the cut portions of the cable is made with anisotropic conductors, and specifically with Tecknit Fuzz Buttons. More particularly, these Tecknit Fuzz Buttons are made form gold-plated molybdenum wires having diameters in the range of approximately one to two mils. It is estimated that the connection scheme of FIG. 8 can provide connection between two cables for signals up to approximately 26 GHz within a 3 dB attenuation budget.

Figure 9:
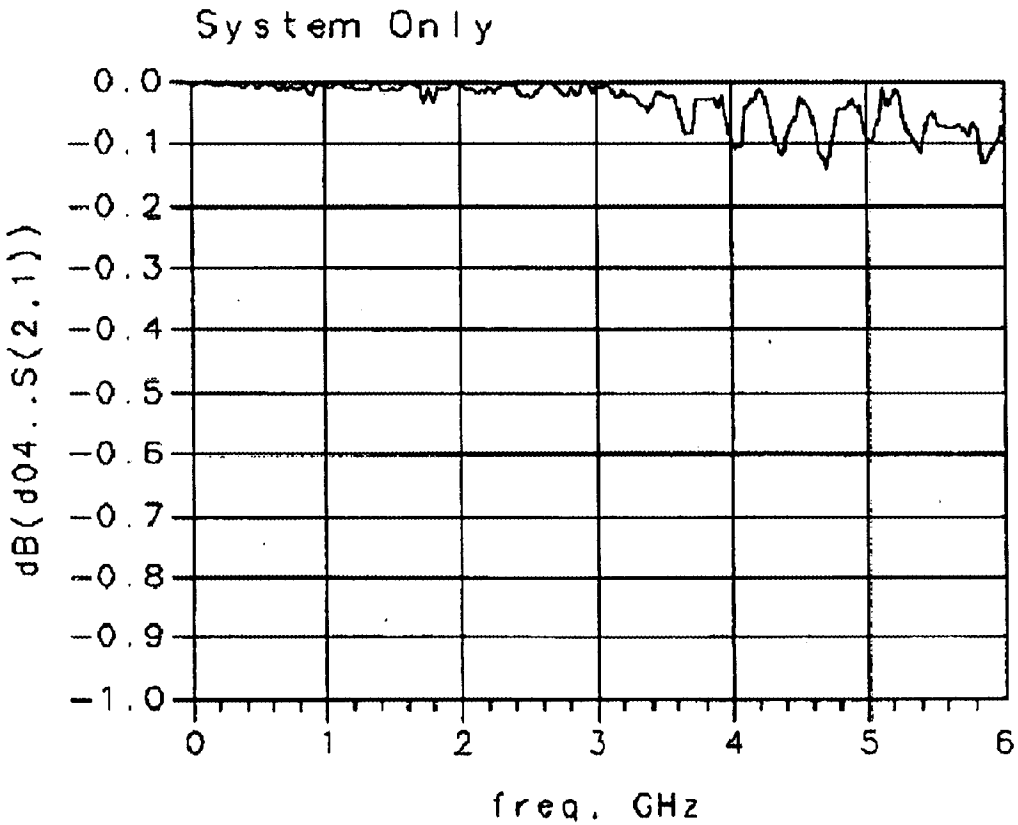
Figure 10:
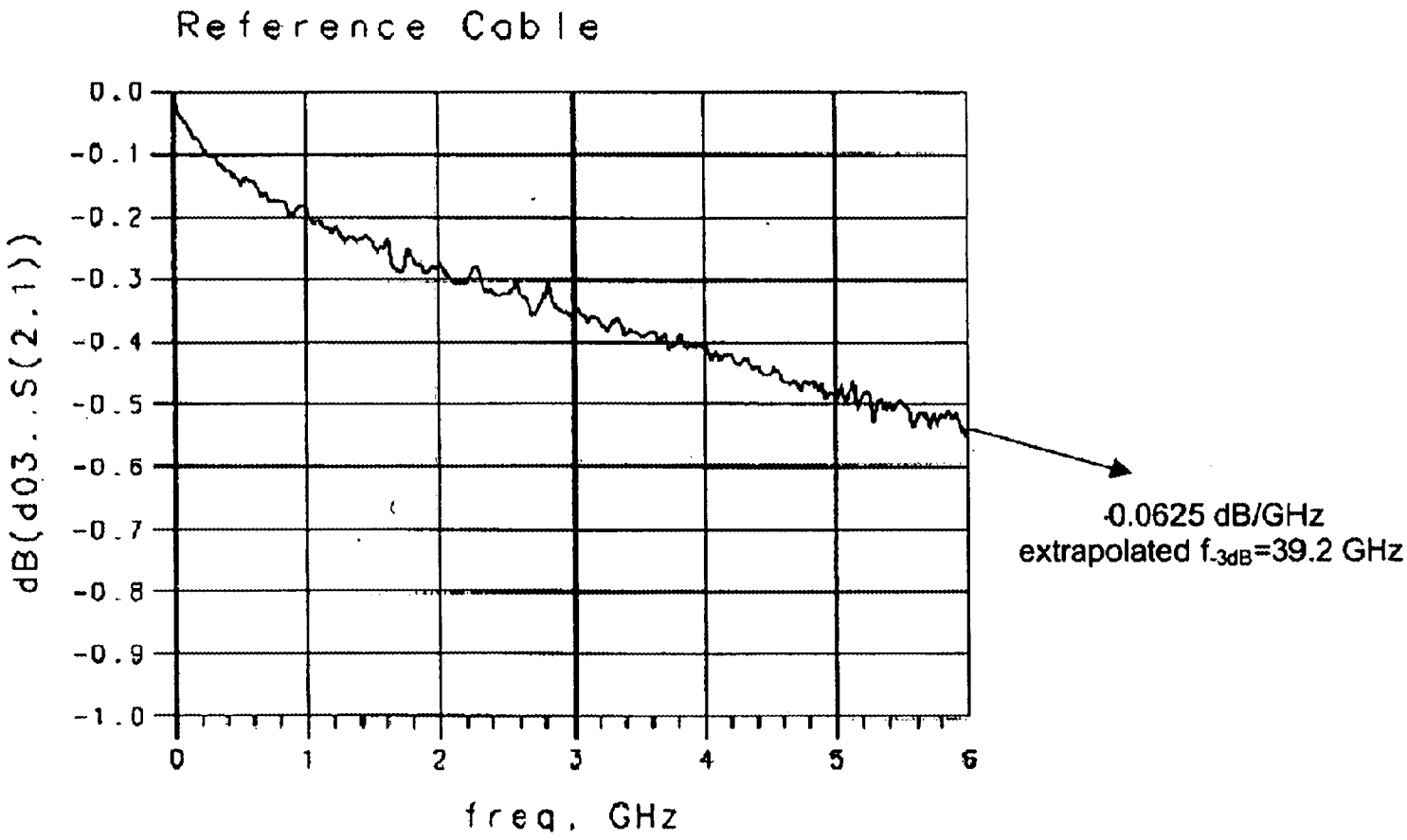

FIG. 9 is a diagram showing signal attenuation over a frequency range of 0 to 6 GHz for only about 24 inches of medium performance flex coax cable, used to characterize the test equipment. As can be seen in the figure, there is very little attenuation between 0 and 3 GHz, with losses reaching approximately 0.1 dB in the range of 3 GHz to 6 GHz. This is essentially a measure of the test system itself. FIG. 10 is a diagram showing signal attenuation over a frequency range of 0 to 6 GHz for a reference cable which consists of the system flex coax cable, as described above in connection with FIG. 9, in combination with about 12 inches of 0.085 inch diameter Micro-Coax semi-rigid cable with SMAs coupled thereto. As can be seen in FIG. 10, by extrapolating at −0.0625 dB/GHZ it is estimated that the 3 dB down point is reached at approximately 39.2 GHz.

Figure 11:
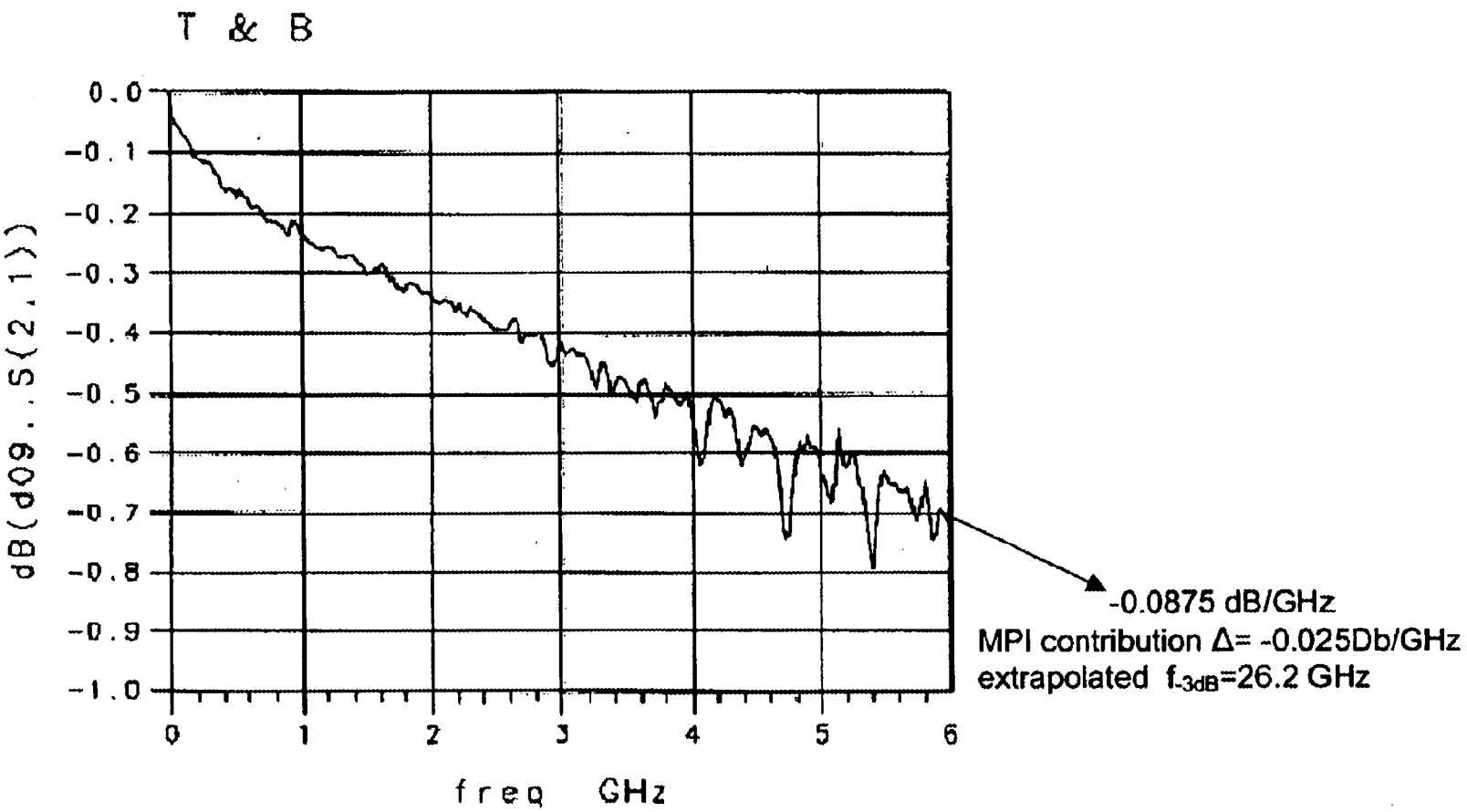

FIG. 11 is a diagram showing signal attenuation over a frequency range of 0 to 6 GHz for the reference cable set-up, but modified to have a first conductive material inserted therebetween in accordance with the present invention. In the example of FIG. 11, a connection scheme in accordance with the present invention uses anisotropic conductors to provide electrical continuity between portions of the reference cable. More particularly, Thomas & Betts (Tyco) metallized particle interconnect bumps (described above) are used to connect the substantially planar surfaces of two portions of the reference cable set-up. As can be seen in the figure, the linearly extrapolated loss above 6 GHz appears to be approximately −0.0875 dB/GHz. The delta between the extrapolated attenuation of FIG. 11 with the Thomas & Betts (Tyco) metallized particle interconnect bumps, and the reference cable set-up of FIG. 10, is −0.025 dB/GHz, which gives an extrapolated 3 dB down point of 26.3 GHz.

Figure 12:
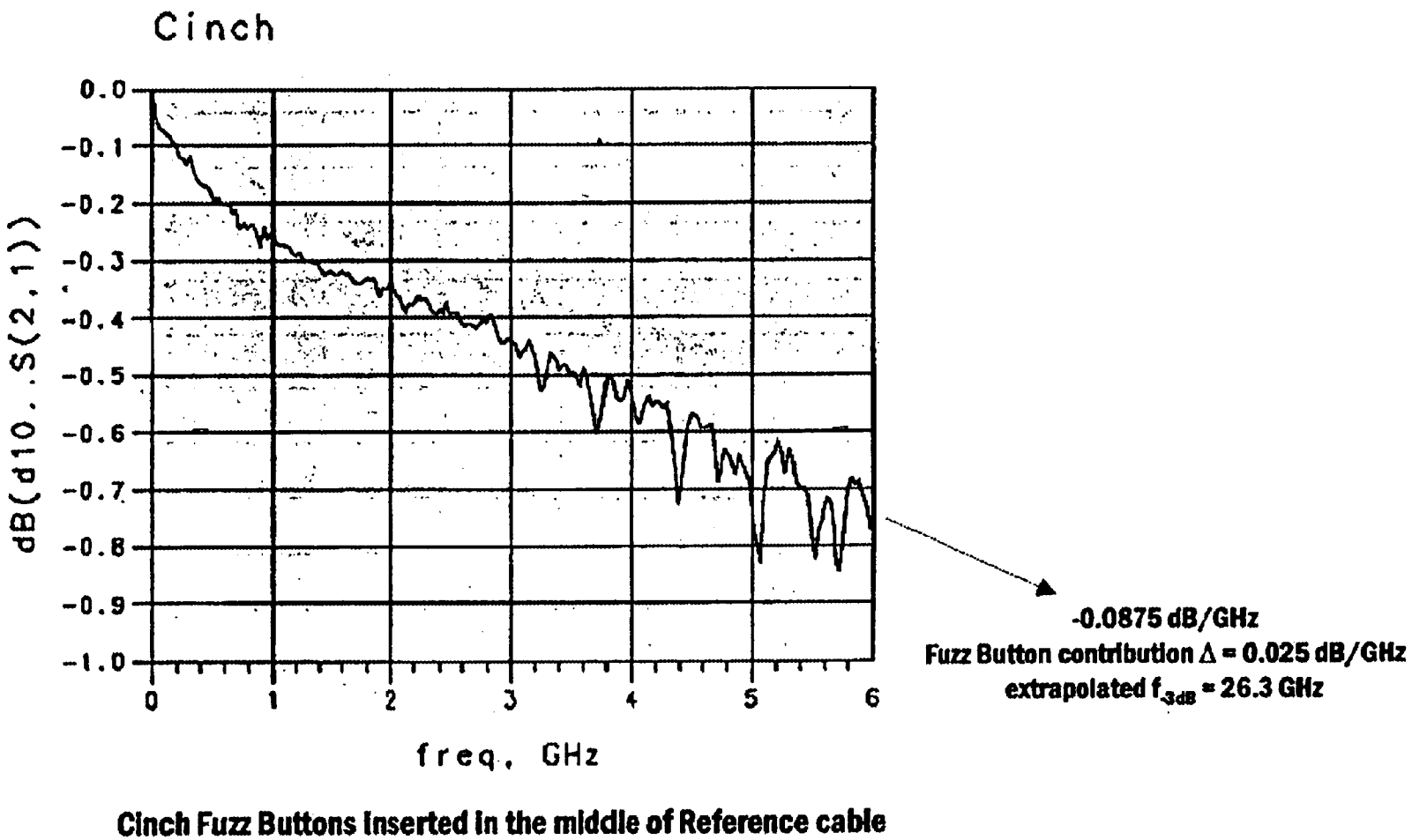

FIG. 12 is a diagram showing signal attenuation over a frequency range of 0 to 6 GHz for the reference cable set-up, but modified to have a second conductive material inserted therebetween in accordance with the present invention. In the example of FIG. 12, a connection scheme in accordance with the present invention uses anisotropic conductors to provide electrical continuity between portions of the reference cable. More particularly, Tecknit Fuzz Buttons (described above) are used to connect the substantially planar surfaces of two portions of the reference cable set-up. As can be seen in the figure, the linearly extrapolated loss above 6 GHz appears to be approximately −0.0875 dB/GHz. The delta between the extrapolated attenuation of FIG. 12 with the Tecknit Fuzz Buttons, and the reference cable set-up of FIG. 10, is −0.025 dB/GHz, which gives an extrapolated 3 dB down point of 26.3 GHz.

Figure 13:
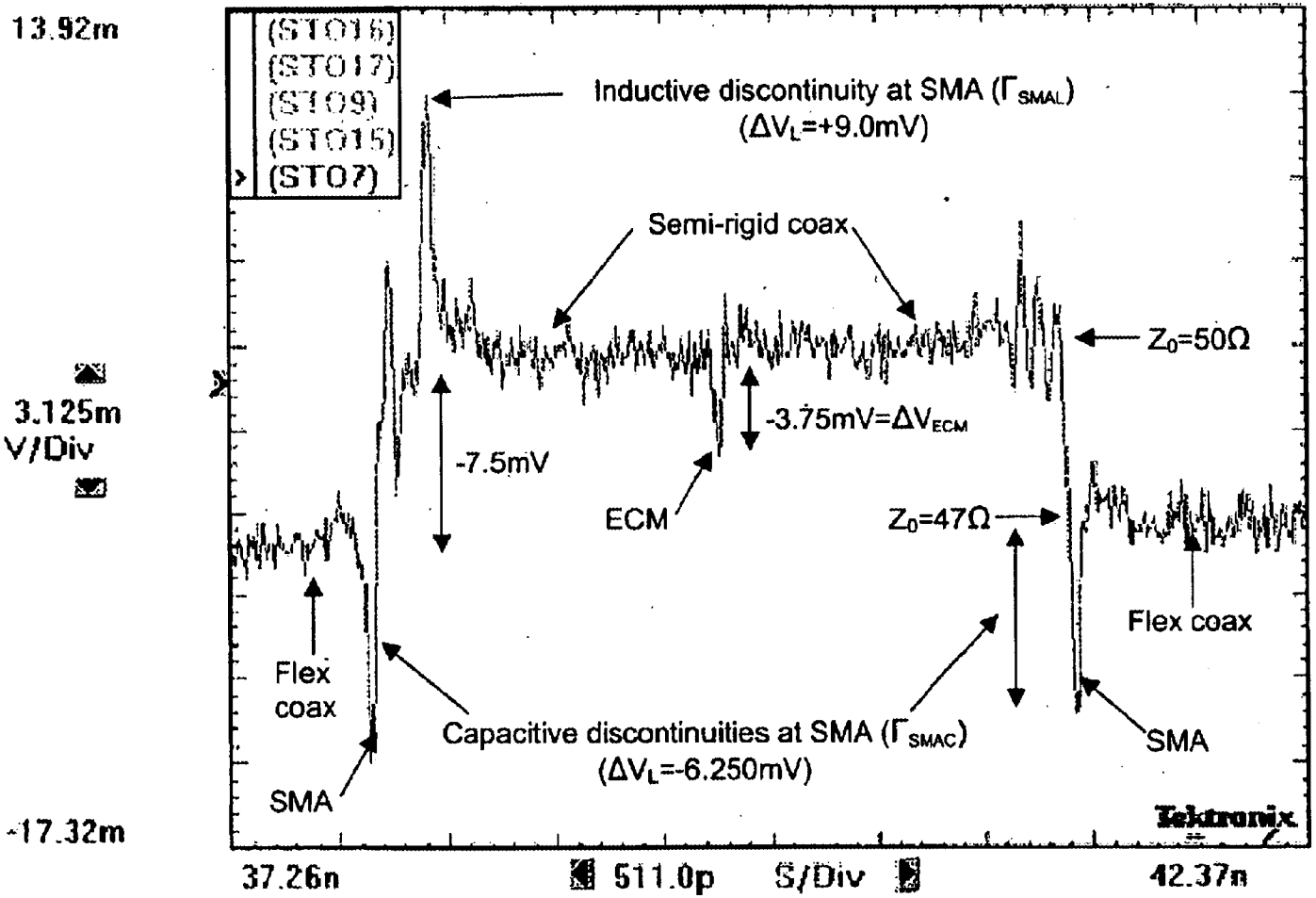

FIG. 13 is a time domain reflectometry picture of test set-up with flex cables coupled to semi-rigid cables and the semi-rigid cables having an ECM coupling.

Figure 14:
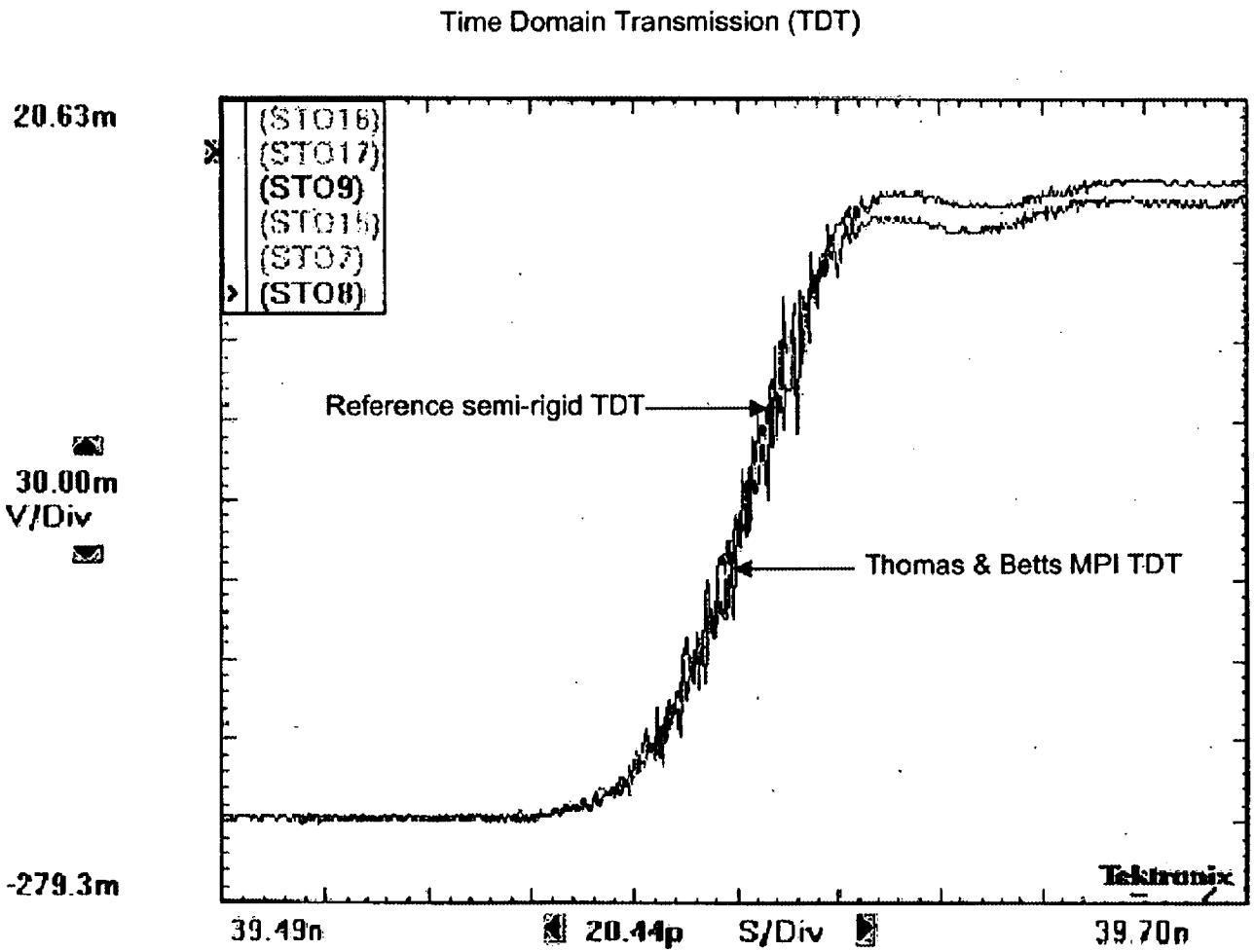

FIG. 14 is a time domain transmission (TDT) picture of the reference set-up versus the reference set-up with a first conductive material, i.e., Thomas & Betts (Tyco) metallized particle interconnect bumps, inserted therein. As can be seen from the figure, the TDT traces for the reference semi-rigid cable and semi-rigid cable with metallized particle interconnect bumps are almost indistinguishable going through a transition from a low level to a high level (approximately one-quarter volt). This is one measure of the efficacy of a connection scheme in accordance with the present invention.

Figure 15:
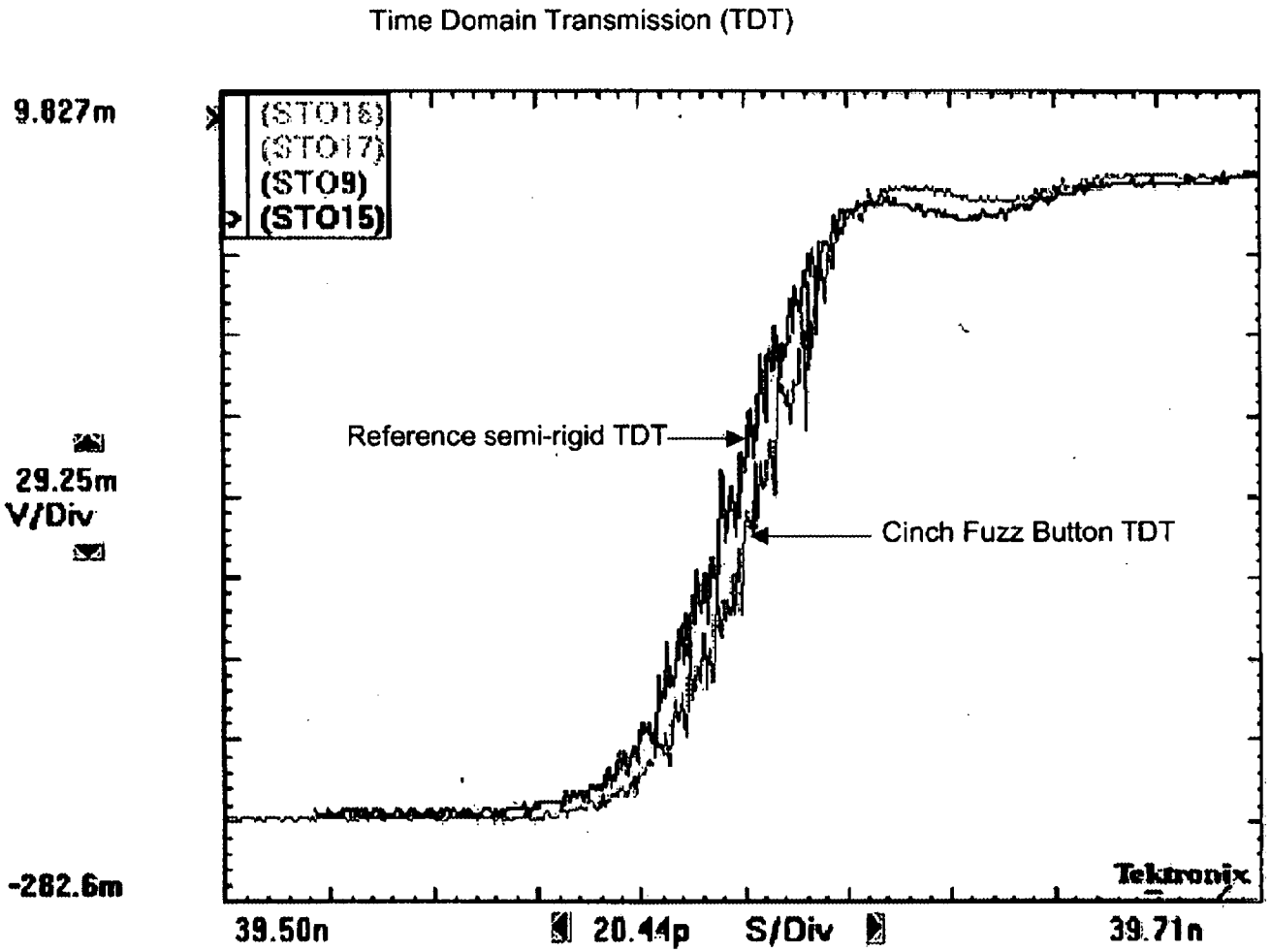

FIG. 15 is a time domain transmission picture of the reference set-up versus the reference set-up with a second conductive material, i.e., Tecknit Fuzz Buttons, inserted therein. As can be seen from the figure, the TDT traces for the reference semi-rigid cable and semi-rigid cable with Tecknit Fuzz Buttons are very similar, with a delay difference of approximately four picoseconds between the reference and the invention using Tecknit Fuzz Buttons while going through a transition from a low level to a high level (approximately one-quarter volt). This is one measure of the efficacy of a connection scheme in accordance with the present invention.

Figure 16:
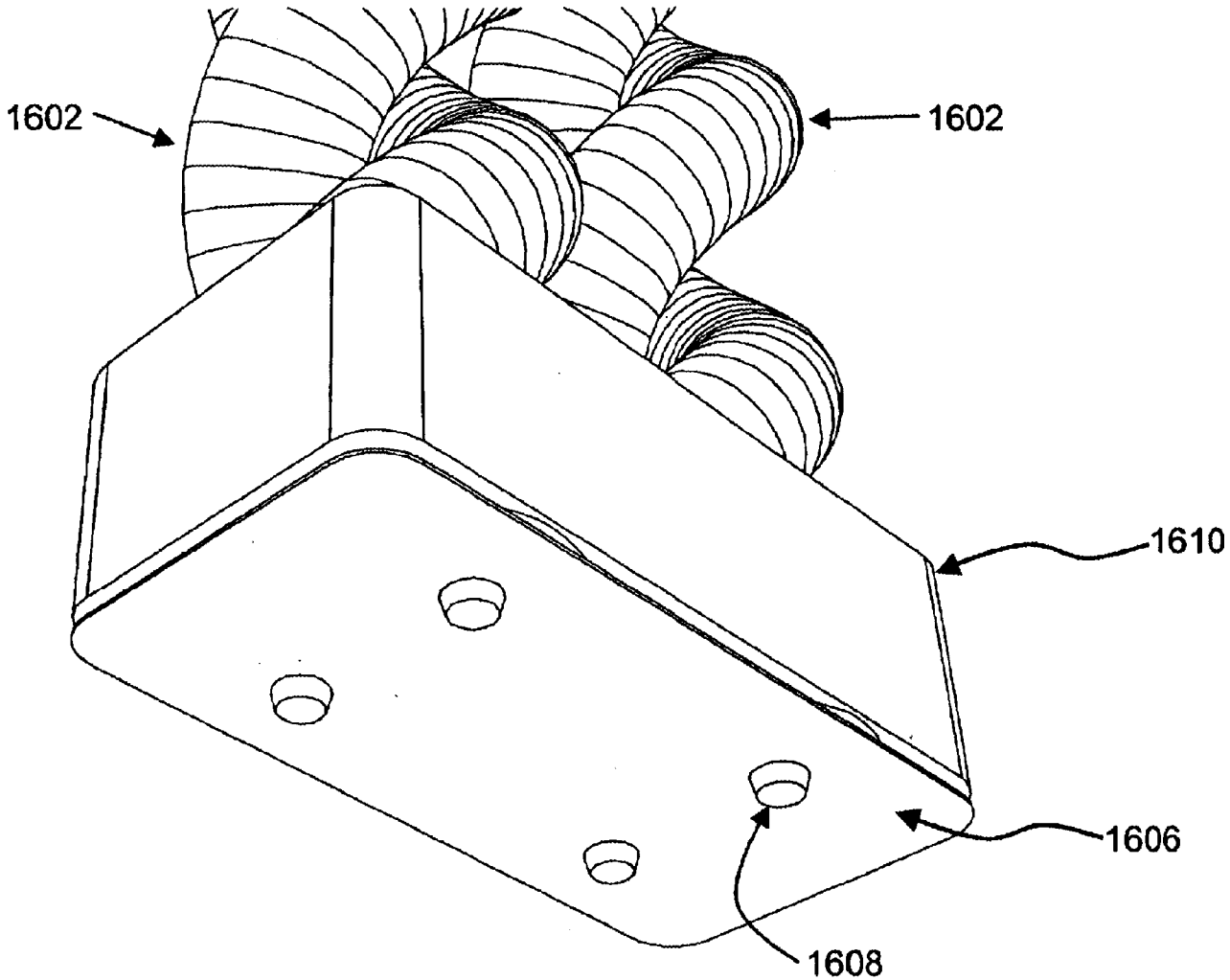
FIG. 16 illustrates an alternative embodiment in which insulated twisted pairs of conductors are connected to other conductors via a planar interface and a connector housing in accordance with the present invention.

FIG. 16 illustrates an alternative embodiment in which insulated twisted pairs of conductors can be connected to other conductors via a planar interface and a connector housing in accordance with the present invention. A first twisted pair 1602 and a second twisted pair 1604 are shown coupled to a housing 1610. The ends conductors of each of twisted pairs 1602, 1604 are each prepared so as to have a substantially planar interface. In other words the conductors and insulators are cut so that they may have an interface that fits flush with conductors 1608 that are fitted into a bottom plate 1606 of housing 1610. This illustrative embodiment shows two sets of twisted pairs, but the invention is not limited to any particular number of twisted pairs.

Figure 17:
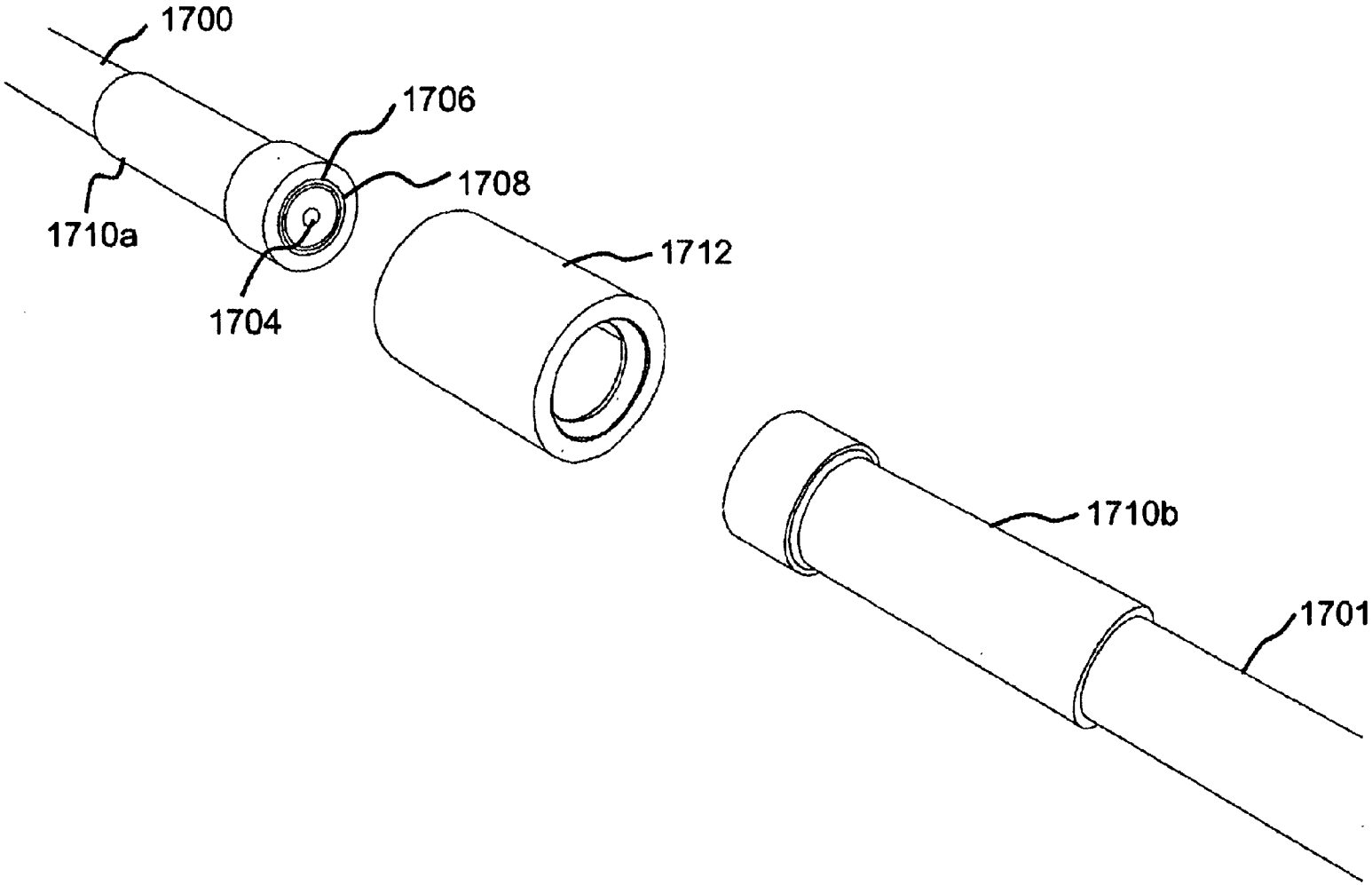
FIG. 17 illustrates an alternative embodiment in which two coaxial cables are joined to each other via a planar interface and a connector housing in accordance with the present invention.

FIG. 17 illustrates an alternative embodiment in which two coaxial cables are joined to each other via a planar interface and a connector housing in accordance with the present invention. More particularly, a first coax cable 1700 has a center conductor 1702, a dielectric layer 1704, a conductive shield 1706, and an outer insulating layer 1708. As illustrated, center conductor 1702, dielectric layer 1704, conductive shield 1706 and outer insulating layer 1708 are cut so as to form a substantially coplanar set of surfaces, referred to as the coax planar interface. A second coax cable 1701 is similarly constructed. First coax able 1701 has disposed thereon, at the planar interface end of coax cable 1701, a first connector sleeve 1710*a* as shown in the figure. Second coax cable 1701 similarly has a second connector sleeve 1710*b* disposed thereon at the planar interface end thereof. In accordance with the present invention, first coax cable 1700 and second coax cable 1701 a mechanically and electrically coupled by bringing each of them into electrical contact with the other within third connector sleeve 1712. Third connector sleeve 1712 serves to maintain the mechanical relationship between the two coax cables. In typical embodiments of the present invention, an anisotropic conductor is disposed between the planar interfaces of first and second coax cables 1700, 1701, respectively. First, second and third connector sleeves 1710*a*, 1710*b*, and 1712 are typically made of an electrically non-conductive plastic.

Exemplary Methods

Figure 18:
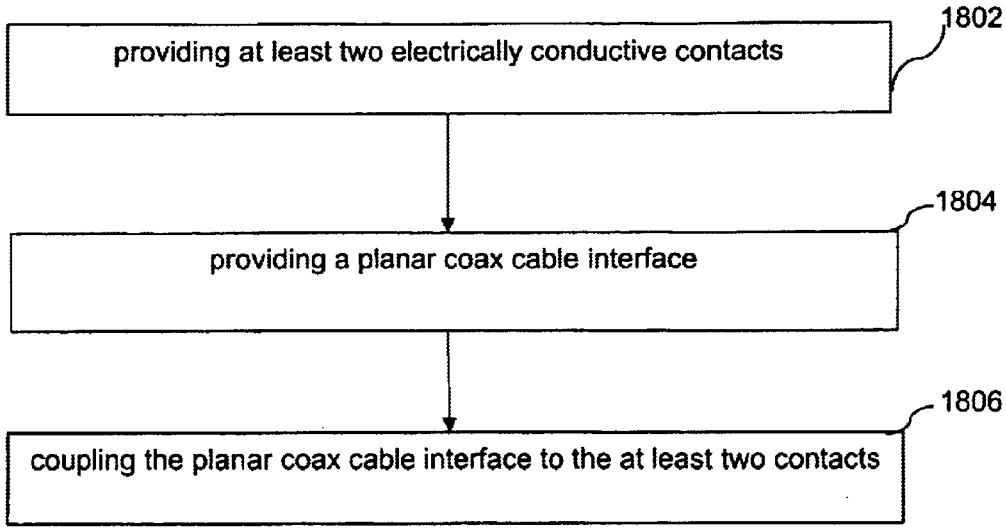
FIG. 18 is a flow diagram of an illustrative embodiment of the present invention.

Referring to FIG. 18, an illustrative method of connecting a coax cable to a substrate in accordance with the present invention includes, providing 1802 at least two electrically conductive contacts disposed on a surface of the substrate. These electrically conductive contacts may include, but are not limited to, anisotropic conductors. Providing 1804 a coax cable having a planar coax cable interface. In this illustrative method, the planar coax cable interface includes a first conductor surface, a first dielectric surface, and a second conductor surface, wherein the first, second, and third surfaces are substantially coplanar with each other. For example, a planar coax cable interface is formed by cutting the coax cable such that the insulator, the shield, the dielectric, and the center conductor remain coextensive. That is, to the extent possible given the tolerances of manufacturing equipment, having the end surfaces of the insulator, shield, dielectric, and center conductor, line up evenly with each other. This even alignment of surfaces, within manufacturing tolerances, is referred to herein as being substantially coplanar, and is alternatively referred to as a planar coax cable interface. The illustrative method further includes, after providing a coax cable having a planar coax cable interface, coupling 1806 the planar coax cable interface to the at least two conductive contacts.

Figure 19:
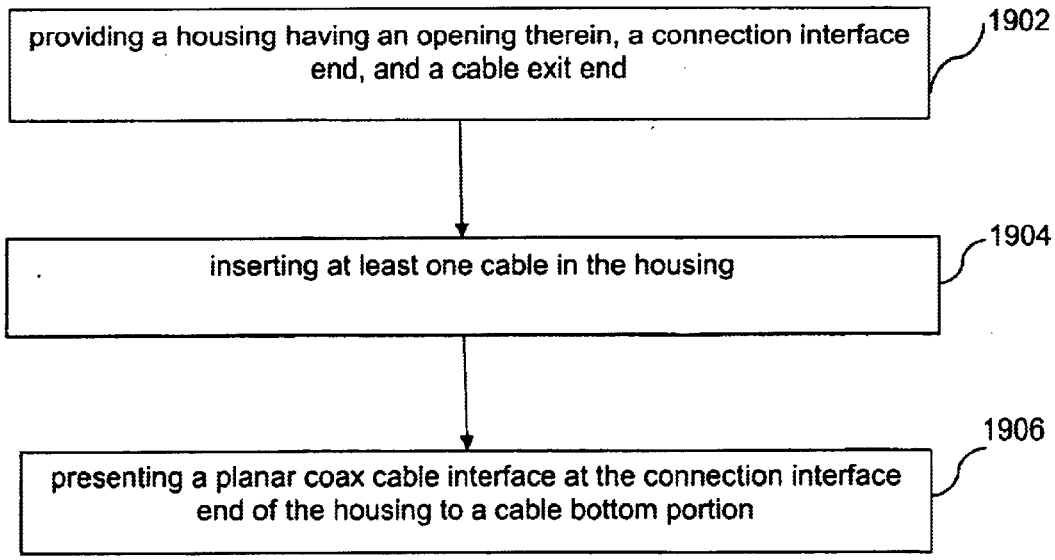
FIG. 19 is a flow diagram of an illustrative embodiment of the present invention.

Referring to FIG. 19, an illustrative method of making a connector, includes providing 1902 a housing having an opening therein, the opening adapted to allow insertion of at least one coax cable in the opening, the housing further having a connection interface end, and a cable exit end. The housing is typically formed from an electrically insulating, and easy to mold material such as plastic. A coax cable is then inserted 1904 into the opening in the housing. It is noted that in alternative embodiments of the present invention, the housing may include multiple openings so as to accommodate more than one coaxial cable, and in such embodiments at least one coaxial cable occupies at least a portion of an opening in the housing. In this illustrative embodiment, the coax cable has a planar coax cable interface and the method includes presenting 1906 that planar interface at the connection interface end of the housing to a cable bottom portion, whereby an electrical connection between the planar coax cable interface and the cable bottom portion is obtained. The cable bottom portion is mechanically coupled to the housing. As noted above, the planar coax cable interface includes a first conductor surface, a first dielectric surface, and a second conductor surface, and the first conductor surface, the first dielectric surface, and the second conductor surface are substantially coplanar with each other.

CONCLUSION

Thus, it can be seen from the above descriptions that methods and apparatus for making electrical interconnections with reduced impedance mismatches have been described.

An advantage of some embodiments of the present invention is that higher operating frequencies for various electrical systems can be obtained.

While the present invention has been described in terms of the above-described embodiments, those skilled in the art will recognize that the invention is not limited to the embodiments described. The present invention can be practiced with modification and alteration within the spirit and scope of the subjoined claims. Thus, the description is to be regarded as illustrative instead of restrictive on the present invention.

What is claimed is:

1. An apparatus, comprising:

a connector housing, the connector housing having a bottom plate at a first end thereof;

a first twisted pair of insulated conductors, at least a portion of which are disposed in the housing, each of the insulated conductors of the first twisted pair having, at a first common end, a first planar interface;

an anisotropic conductive layer disposed between the first planar interface of each of the insulated conductors of the first twisted pair and the bottom plate, such that electrical connection is made therebetween;

wherein each conductor of the first twisted pair of insulated conductors is available for electrical connection through the bottom plate.

2. The apparatus of claim 1, further comprising a second twisted pair of insulated conductors, at least a portion of which are disposed in the housing, each of the insulated conductors of the second twisted pair having, at a second common end, a second planar interface.

3. The apparatus of claim 1, wherein the connector housing includes sidewalls that are substantially perpendicular to the bottom plate.

4. The apparatus of claim 1, wherein the first planar interlace comprises an exposed cross-sectional conductor surface that is coplanar with a cross-sectional surface of its insulator.

5. The apparatus of claim 2, wherein the second planar interface comprises an exposed cross-sectional conductor surface that is coplanar with a cross-sectional surface of its insulator.

6. The apparatus of claim 2, wherein the portion of the first twisted pair of insulated conductors disposed in the connector housing, and the portion of the second twisted pair of insulated conductors disposed in the connector housing, are held in a spaced apart relation with respect to each other by the connector housing.

7. The apparatus of claim 3, wherein the sidewalls have outer surfaces, and the outer surfaces are electrically non-conductive.

8. The apparatus of claim 6, wherein the bottom plate comprises a plurality of connection terminals protruding outwardly therefrom.

9. The apparatus of claim 8, wherein the connector housing comprises plastic.

10. The apparatus of claim 9, wherein each of the plurality of connection terminals is electrically connected with corresponding one of the insulated conductors.

11. The apparatus of claim 9, further comprising a plurality of twisted pairs of insulated conductor, each twisted pair of the plurality of twisted pairs being disposed within the connector housing.

* * * * *